US005472198A

United States Patent [19]

Alvarez

[11] Patent Number: 5,472,198

[45] Date of Patent: Dec. 5, 1995

[54] CARDS HOLDER FOR PLAYING CARD GAMES

[76] Inventor: Moises N. Alvarez, 5870 W. 26th Ave., Hialeah, Fla. 33016

[21] Appl. No.: 270,731

[22] Filed: Jul. 5, 1994

[51] Int. Cl.[6] ..... A63F 1/10

[52] U.S. Cl. ..... 273/150; 63/15; 63/1.1; 63/2; 63/15.5

[58] Field of Search ..... 273/150; 63/15, 63/1.1, 2, 15.5

[56] References Cited

U.S. PATENT DOCUMENTS

| | | | |
|---|---|---|---|
| D. 74,537 | 2/1928 | Anderson | 273/150 |
| 1,705,349 | 3/1929 | Youngren | 273/150 |
| 1,731,574 | 10/1929 | House | 63/1.1 |
| 2,102,220 | 12/1937 | Richardson | 273/150 |
| 2,222,741 | 11/1940 | Bush | 224/217 |
| 2,231,637 | 2/1941 | Ramos | 273/150 |
| 2,818,262 | 12/1957 | Nanna | 273/150 |
| 3,596,964 | 8/1971 | Zazzara | 224/217 |
| 4,630,824 | 12/1986 | Sweet | 273/150 |
| 5,029,797 | 7/1991 | Levorchick et al. | 273/150 |

FOREIGN PATENT DOCUMENTS

| | | | |
|---|---|---|---|
| 2166 | 4/1900 | Austria | 273/150 |
| 55456 | 4/1911 | Switzerland | 273/150 |

*Primary Examiner*—Benjamin H. Layno

[57] ABSTRACT

A playing card holder is described in which a hand shape brace with rubber finger tips is attached by a pin to a backplate with a clip resting on one end of the spring action to the brace and the other end to the backplate. The hand shape brace will be pressed down to allow the insertion of the cards between the brace and the backplate. The clip action and the finger tips of the hand shape brace will supply the necessary pressure and securement to keep the cards in place and yet permitting the cards to be easily removed without dislodging adjacent cards.

1 Claim, 2 Drawing Sheets

CARDS HOLDER FOR PLAYING CARD GAMES

FIELD OF INVENTION

This present invention enhances an improved device for holding cards while players are engaged in card games.

The major attribute is that cards will be gripped to the device more securely, it also deletes the requirement for the skill in card assembly in the human hand, plus a better grip created by the rubber tips in the hand shape brace.

Essentially, it enables card players to play cards without even having to learn to hold fanned cards in hand.

This present invention holds itself by just wearing the device in the fingers like a ring.

DESCRIPTION OF PRIOR ART

All other inventions to date that were designed to eliminate the awkward handling of card fan have addressed and alleviated a large degree of hand manipulation, but all still require a small percentage of actual hand control function.

In summation all other invented devices which were designed to delete the use and skill of hand muscle manipulation have failed to achieve the completed design. So ultimately they also fail all the other functions required by its purpose in card handling.

Conclusively the invention is not complete unless it meets its total objective of absolutely deleting hand muscle manipulation while it is functioning for the card player.

One prior art properly allows cards to be fanned and viewed while they place in-between two connected wafer plates. With nominal pressure between hand and palm it meets objective of card holder.

Yet since it still requires the function of hand muscle use, it does not achieve the total objective it was invented for.

Another prior art is an approximate two inch wafer plate with a plastic clip on one side to hold card hand, and a "T" shaped extension on the other side of wafer plate that the player positions in between his fingers. It again, essentially meets some of the objective, yet it still requires the depression of the two fingers to "HOLD" the card holder.

In conclusion, all other devices have addressed the objective of holding cards, but where there is still a requirement of hand muscle manipulation for their use, they only partially meet their objective of enhancing the card holding for player convenience.

Since the holding of cards is a minor annoyance to players a device that sets out to eliminate this annoyance should eliminate it entirely, which all prior arts have not achieved.

Obviously this leaves open, a demand for a card holding device that totally deletes the requirement of hand muscle use, and a more secure hold on the cards.

SUMMARY OF INVENTION

The present invention has as an underlying objective the improvement of the prior art by arranging a better mechanism and using an improved gripping material and method where the cards will be more secure in the card holding device.

Another object is to improve the prior art by providing a simple and improved holding device in which the card holder has no requirement of hand muscle use or coordination to play or view the cards after placing the cards in between the backplate and the hand shape brace.

An additional object is to provide a new improve card holding device that requires no prior knowledge or skill to operate and use.

A further object of the instant invention is to provide a device of which its design and shape is comfortable to accomodate in the hand.

DETAILED DESCRIPTION OF PREFERRED EMBODIMENTS

Figure 1:
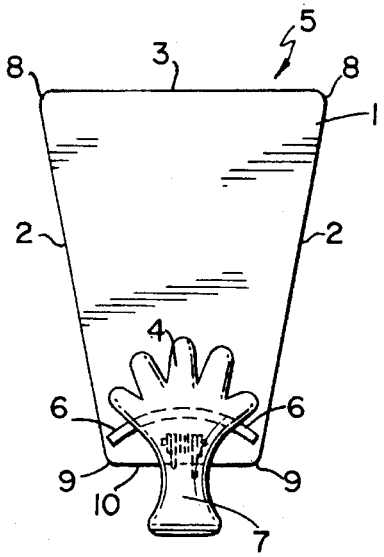
FIG. 1 and 1A are a front view of the card holder without the cards with a close view detail of the mechanism.
Figure 1A:
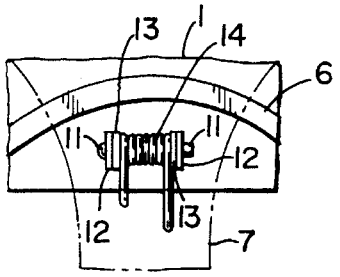
Figure 2:
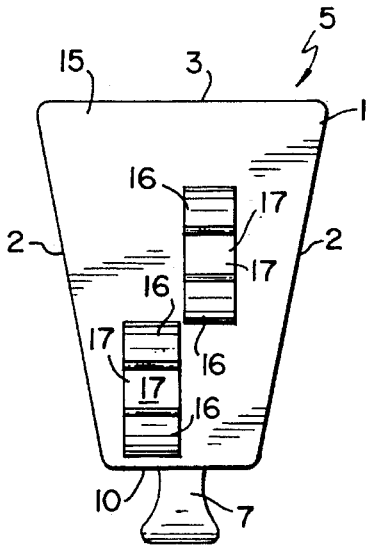
FIG. 2 is a rear view thereof.
Figure 3:
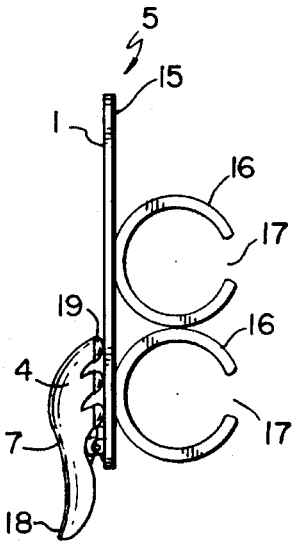
FIG. 3 and 3A are a right side view, with a close view detail of mechanism.
Figure 3A:
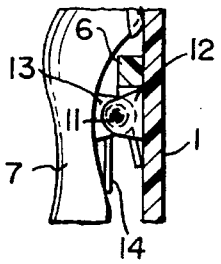
Figure 4:
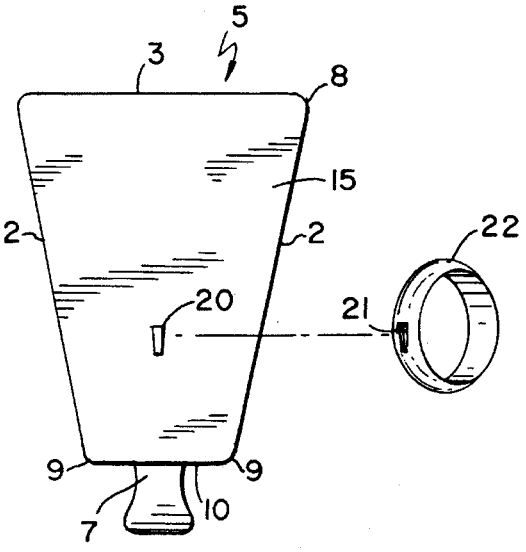
FIG. 4 is a rear view of the same card holder invention as FIG. 2, only in one-ring version, which shows a male attachment in the rear of the backplate as well as female attachment in the ring.
Figure 5:
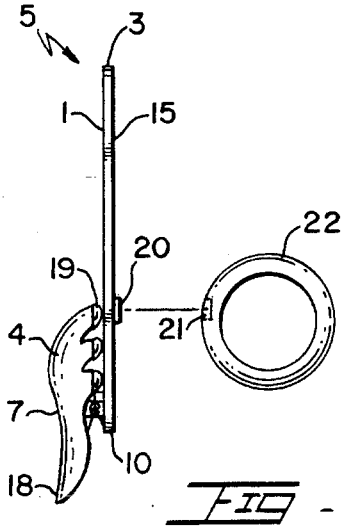
FIG. 5 is a right side view of the same card holder invention as FIG. 3, only in a one-ring version which shows a male and female respectively instead of the adjustables rings.

Initially, specific reference is made to the card holder illustrated in FIGS. 1–6 wherein my card holder as generally designated by the reference numeral 5.

FIG. 1, shows a card holder 5 embodying the invention, preferably, but not limited made from stiffly flexible plastic material such as P.V.C. nylon polypropylene, etc.

The backplate 1 is semi-rectangular in shape narrowing at the bottom 10 from the top 3, with upper right, and left corners 8, and bottom right and left corners 9 rounded.

The backplate 1 is provided in its lower area above the ears 13, with a flanger or shelf 6 which function is to limit the extent to which gripped hand of cards may be fanned-out, also leveling the cards according to the point of pressure from the finger shape 4 of the brace 7.

The brace 7 is provided with a pair of ears 12 to which are pivoted the ears 13 of the backplate 1 by means of a horizontal pin 11.

A spring 14 is mounted on a pin 11, and maintains the brace 7 and the backplate 1 normally engaged. The brace 7 is also provided above its pivot point with five fingers shape 4 preferably concavely curved, spread apart from each other to engage the front of a suitably fanned-out hand of cards 23 (FIG. 6) simulating the result from a manual holding.

Figure 6:
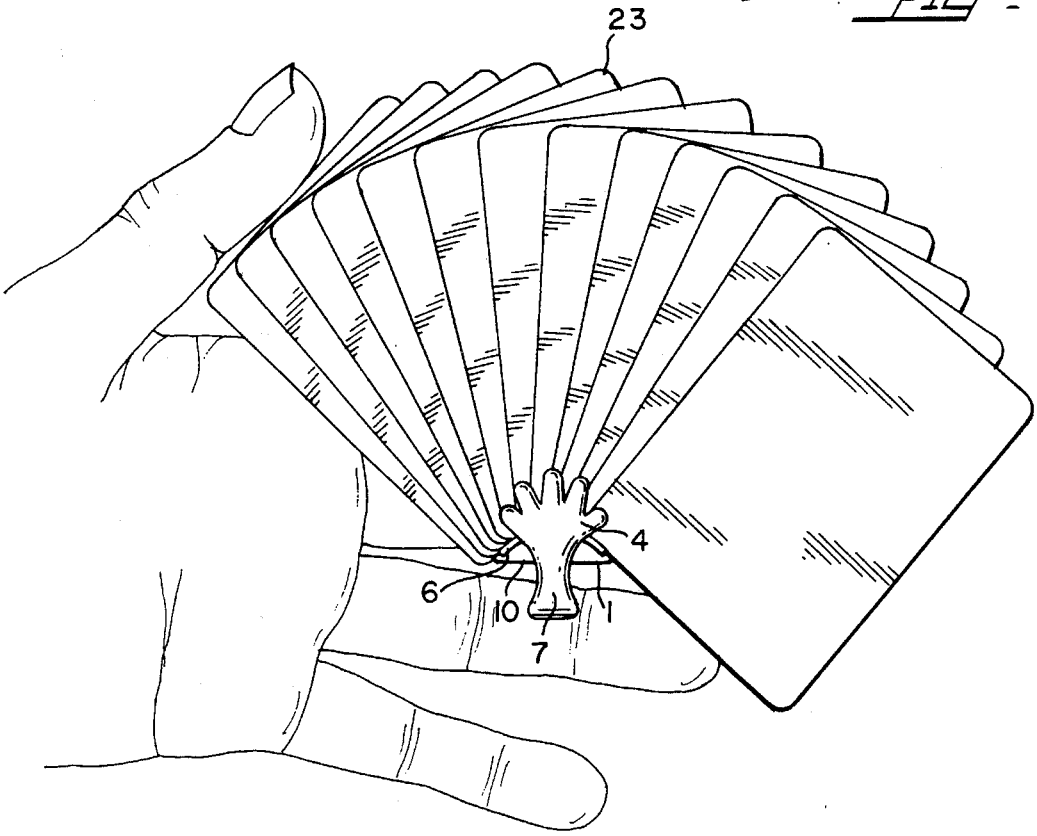
FIG. 6 is a front view of the card holder embodying the invention, with the cards thereon.

The flange or shelf 6 extends from the lower left side 2, to the lower right side 2 in a semi-circle form in concordance with the bottom edge of a fanned-out hand of cards 23 (FIG. 6).

The rear view of the embodiment of the present invention can be observed in (FIG. 2) and (FIG. 3) where two rings 16 are bonded to the backplate 15 to act as a retaining elements for positioning the card holder 5 in a desirable holding position since the objective of the rings 16 is to retain or hold the card holder 5 in place without having to use hand muscle manipulation.

The actual wearing of this ring 16 could change size from one player to another, for that purpose, a gap or opening 17 instead of connecting or closing the rings 16, is appropriate, serving as an adjustable mean for different size fingers.

The right size of the embodiment of the present invention in (FIG. 3), details the whole mechanism, where the brace 7 is concavely curved from point 4 to point 18, that when press at its lower end 18, the pivot action from the ears 12 of the backplate 1 and the ears 13 of the brace 7, attached by pin 11 with spring 14 in between ears 12 and 13, would allow the finger shape 4 with its rubber tips 19 to disengage from the backplate 1 permitting the insertion of the cards, which after releasing the brace 7 would press the cards to the backplate 1 with the rubber tips 19 at the end of the finger shape 4 of the brace 7.

The spring 14 (FIG. 3) the opposite ends of which press against the brace 7 and the lower area of the backplate 1, respectively, is mounted on the pin 11 and maintains the concavely curved position of the brace and/or the finger shape 4 and the back-1 normally engaged.

The brace 7 and the backplate 1 cooperate with each other to form a clip for gripping between them one or more cards.

On (FIG. 4 and 5) shows a card holder 5 as in (FIG. 1 and 3), with a variation only in the retaining element.

This card holder 5 only difference is, that instead of having two rings 16 has a single customize to a specific size ring 22 with a female attachment 21 which allow the male attachment 20, located in the center of the backplate 15, to be inserted and lock in.

The wearing of this ring 22 in certain finger, may change from one player to another, depending on the player's ability to use this finger and/or his stretching capabilities, even though, it is suggested to be worn in the index finger.

FIG. 6 is intended to show a more actual position of the card holder 5 in a player's hand.

It is recommended that the rings 16 (not shown in FIG. 6) should be worn in the index and middle finger for a better reach when pressing at lower 18 of the brace 7 with thumb, before inserting the cards 23 in between the backplate 1 and the brace 7.

The foregoing detailed description is to be clearly understood as given by way of illustration and example only and that is not intended to be limited to the details above since it is recognized that various modifications, omissions or substitutions in the operation, form and details of the instant device illustrated, may be made by the manufacturer within the scope of the appended claims without departing in any way from the spirit of the instant invention and its marketing concept.

I claim:

1. A card holder comprising in combination:

a rectangular-shaped backplate having a face side and a back side, manufactured from plastic, metal, or any other durable material, for serving as a leaning support for the cards, the backplate having a protruding lip or shelf mounted horizontally from side to side in a semi-circle approximately ½" from the bottom of the face of the backplate for limiting the extent of the lower edge of the cards after the cards are fanned-out, the backplate having two ears mounted in the middle of the face of the backplate about ⅛" from the bottom of the backplate, the two ears each having holes therethrough, the backplate further including a male member protruding from the center of the back of the backplate, a hand shaped brace manufactured from plastic, metal, or any other durable material, having fingers and rubber tips at the end of the fingers, the brace also having two ears mounted below the fingers, the two ears each having holes therethrough, the brace is pivotally attached to the face of the backplate by a pin engaging the ears of the backplate to the ears of the brace, wherein the pin is inserted through the holes in all four ears, a metal spring mounted on the pin in between the two ears of the brace, the metal spring biases the fingers of the brace against the face of the backplate for securely holding the cards, and a ring for wearing on one's finger having a female member sized to receive the male member of the backplate for attachment thereto, wherein when the ring is attached to the backplate the card holder may be easily be held in one's hand, and when the ring is detached from the backplate, the ring may be worn as a jewelry piece while the backplate may be carried in one's purse or pocket.

* * * * *

UNITED STATES PATENT AND TRADEMARK OFFICE

CERTIFICATE OF CORRECTION

PATENT NO. : 5,472,198

DATED : December 5, 1995

INVENTOR(S) : Moises N. Alvarez

It is certified that error appears in the above-indentified patent and that said Letters Patent is hereby corrected as shown below:

Title page, item [76], inventor's address: should read--10101 West Okeechobee Road. #16102, Hialeah Gardens, Fl. 33016--.

Signed and Sealed this

Twenty-fourth Day of September, 1996

*Attest:*

Bruce Lehman

BRUCE LEHMAN

*Attesting Officer*

*Commissioner of Patents and Trademarks*